US011919701B2

(12) United States Patent
Clayton

(10) Patent No.: US 11,919,701 B2
(45) Date of Patent: Mar. 5, 2024

(54) CONTAINER USED TO TRANSPORT AND PROTECT CONSUMABLE CYLINDRICAL ITEMS

(71) Applicant: Michael Merlin Clayton, Zelienople, PA (US)

(72) Inventor: Michael Merlin Clayton, Zelienople, PA (US)

(73) Assignee: Michael Clayton, Zelienople, PA (US)

( * ) Notice: Subject to any disclaimer, the term of this patent is extended or adjusted under 35 U.S.C. 154(b) by 0 days.

(21) Appl. No.: 18/050,243

(22) Filed: Oct. 27, 2022

(65) Prior Publication Data

US 2023/0150753 A1 May 18, 2023

Related U.S. Application Data

(60) Provisional application No. 63/280,002, filed on Nov. 16, 2021.

(51) Int. Cl.

| | |
|---|---|
| ***A24F 15/00*** | (2020.01) |
| ***B65D 25/10*** | (2006.01) |
| ***B65D 43/16*** | (2006.01) |
| ***B65D 53/02*** | (2006.01) |
| ***B65D 85/10*** | (2006.01) |

(52) U.S. Cl.

CPC ..... *B65D 85/10* (2013.01); *B65D 25/108* (2013.01); *B65D 43/165* (2013.01); *B65D 53/02* (2013.01); *B65D 2543/00972* (2013.01)

(58) Field of Classification Search

CPC ..... B65D 85/10; B65D 85/20; B65D 25/04; B65D 43/16; A24F 15/12; A24F 15/005; A24F 15/01; A24F 15/18; A24F 15/20; A24F 15/00; A24F 19/0064; A24F 23/00

USPC ..... 206/379, 263, 236, 261, 38, 242; 131/180

See application file for complete search history.

(56) References Cited

U.S. PATENT DOCUMENTS

| | | | | |
|---|---|---|---|---|
| 2,836,288 | A * | 5/1958 | Atchison | A24F 15/18 220/849 |
| 8,307,834 | B1 * | 11/2012 | Palmerino, Sr. | A24F 15/005 206/265 |
| 9,648,906 | B2 * | 5/2017 | Fabregas Pedrell | A24F 15/005 |
| 10,414,553 | B2 * | 9/2019 | Ziering | B65D 25/04 |
| 2014/0262884 | A1 * | 9/2014 | Priebe | A61M 5/321 206/538 |

* cited by examiner

*Primary Examiner* — King M Chu

(57) ABSTRACT

A container used to transport and protect cylindrical consumable items is disclosed. This invention has reinforced walls made of a strong plastic material, a large latch that is easy to open, a gasket seal, and a removable insert with contoured inner chambers that reduce the amount of movement the contents of the case can go through during travel. Once the insert is removed the container becomes a crafting station for cylindrical consumables and the insert becomes a stand holder for crafted cylindrical consumables.

7 Claims, 13 Drawing Sheets

CONTAINER USED TO TRANSPORT AND PROTECT CONSUMABLE CYLINDRICAL ITEMS

CROSS-REFERENCE TO RELATED APPLICATION

This nonprovisional utility patent application is a continuation of the provisional patent application 63/280,002 and is claiming the priority filing date of Nov. 16, 1921 set by this provisional patent application.

FIELD OF THE INVENTION

The disclosed invention relates generally to a substantially airtight case for transporting and protecting cylindrical consumables such as cigarettes, joints, pre-rolls, etc. More specifically, the present invention is directed to a case including a large latching closure for ease of use, sealing construction and removable insert used for holding cylindrical consumables.

BACKGROUND OF THE INVENTION

Products with a paper or leaf wrapping containing processed leaf and other substances such as tobacco and/or *cannabis* go by many names, i.e., cigarettes, joints, blunts, etc. Products that consist of a paper wrapping around *cannabis* are commonly referred to as "joints". Products with a leaf wrapping, usually hemp or tobacco, are commonly referred to as "blunts". These products may be machine rolled or hand rolled usually using paper or whole-leaf tobacco. Regardless of the composition and wrapping, these cylindrical consumables are similar in that they have an elongated substantially cylindrical rod shape that is not designed to withstand significant bending or contact with water and other liquids. This makes transporting those products very difficult. They can also be very potent which can be unpleasant to nearby people. The current devices in the field of this invention tend to be difficult to open and are made of moderate materials. They also tend provide minimal protection for the contents inside, aside from the protection of being in the device itself. The most common device used to protect joints are "doob tubes" U.S. Pat. No. D953885. Other devices lack dedicated spaces for each individual consumable allowing them to move around in the devices i.e., Raw Cone Caddy as seen on their website rawhentic-.com or the Oneonta as seen on amazon.com. Some devices do offer protection from liquid through a gasket seal or comparable method such as Paq case U.S. patent Ser. No. 10/414,553. Other devices while not designed specifically for the protection of cylindrical consumables offer protection with reinforced wall designs U.S. Pat. No. 9,637,294B2.

BRIEF SUMMARY OF THE INVENTION

The invention claimed here solves the problems brought forth in the background section. This new invention has reinforced walls made of a strong plastic material. It has a large latch that is easily opened by most people, a gasket seal surrounding the inside perimeter of the case, and a removable insert with conical inner chambers that reduce the amount of movement the contents of the invention can go through. The insert being removable gives the added benefit of becoming a stand for the consumables while on a flat surface. Removing the insert also allows the second portion of this invention to become a portable work station to construct the users desired cylindrical consumable.

A DETAILED DESCRIPTION OF THE INVENTION

Figure 1A:
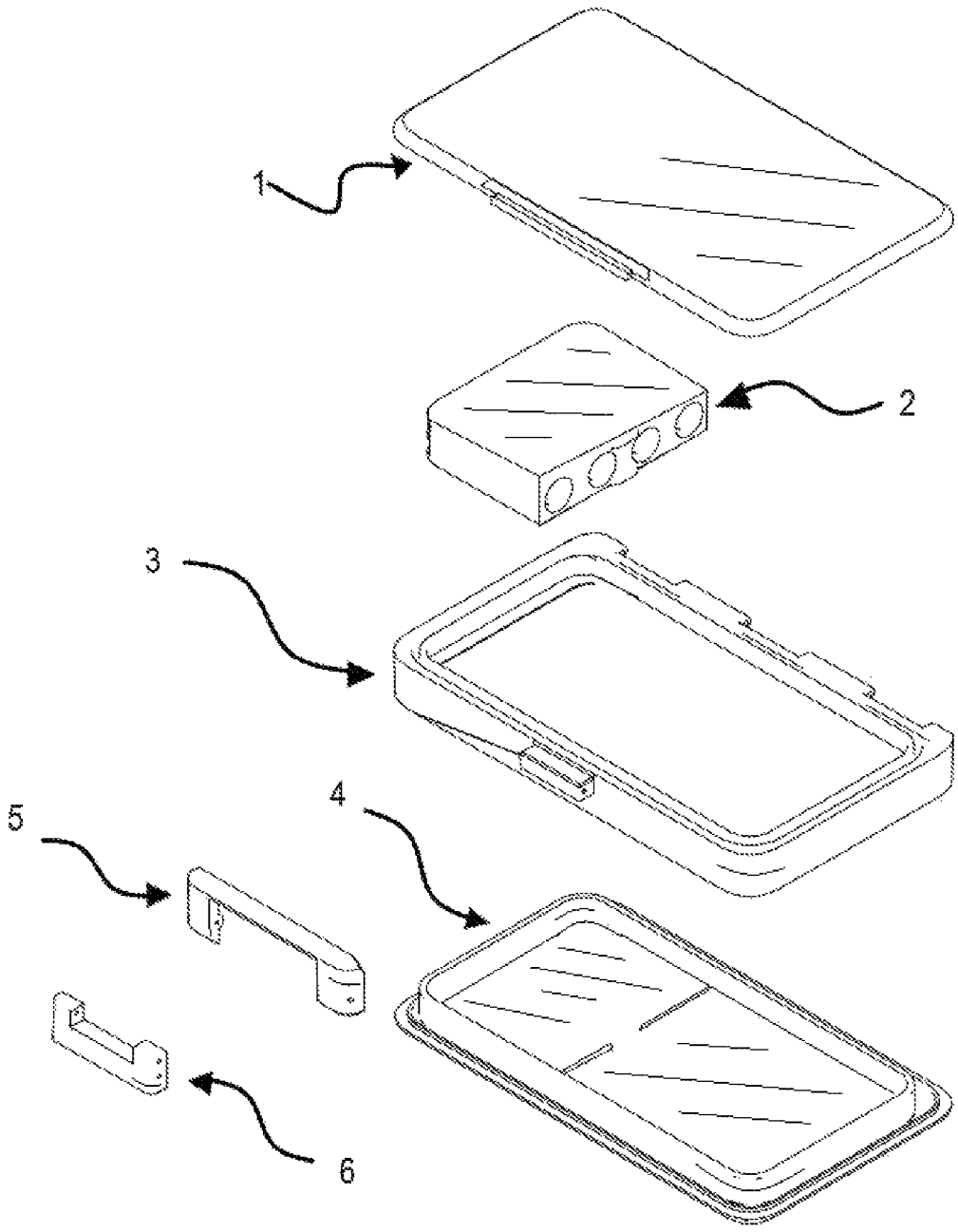
FIG. 1A: Exploded view of the invention showing all of the main components: the container lid, removable insert, container center piece, container base, outer latch, and inner latch.
Figure 1B:
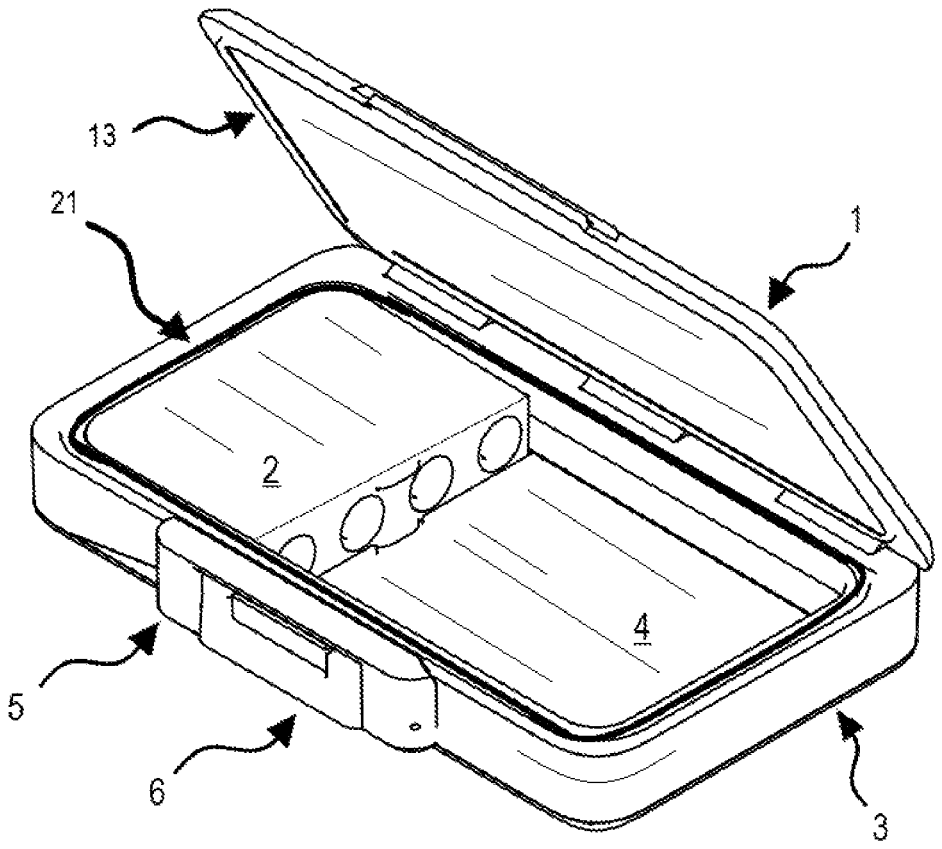
FIG. 1B: Perspective view of the invention. The invention is open with the removable insert placed in its dedicated spot. Pointed out in this figure are the same components as in FIG. 1A with the addition of the gasket.
Figure 1C:
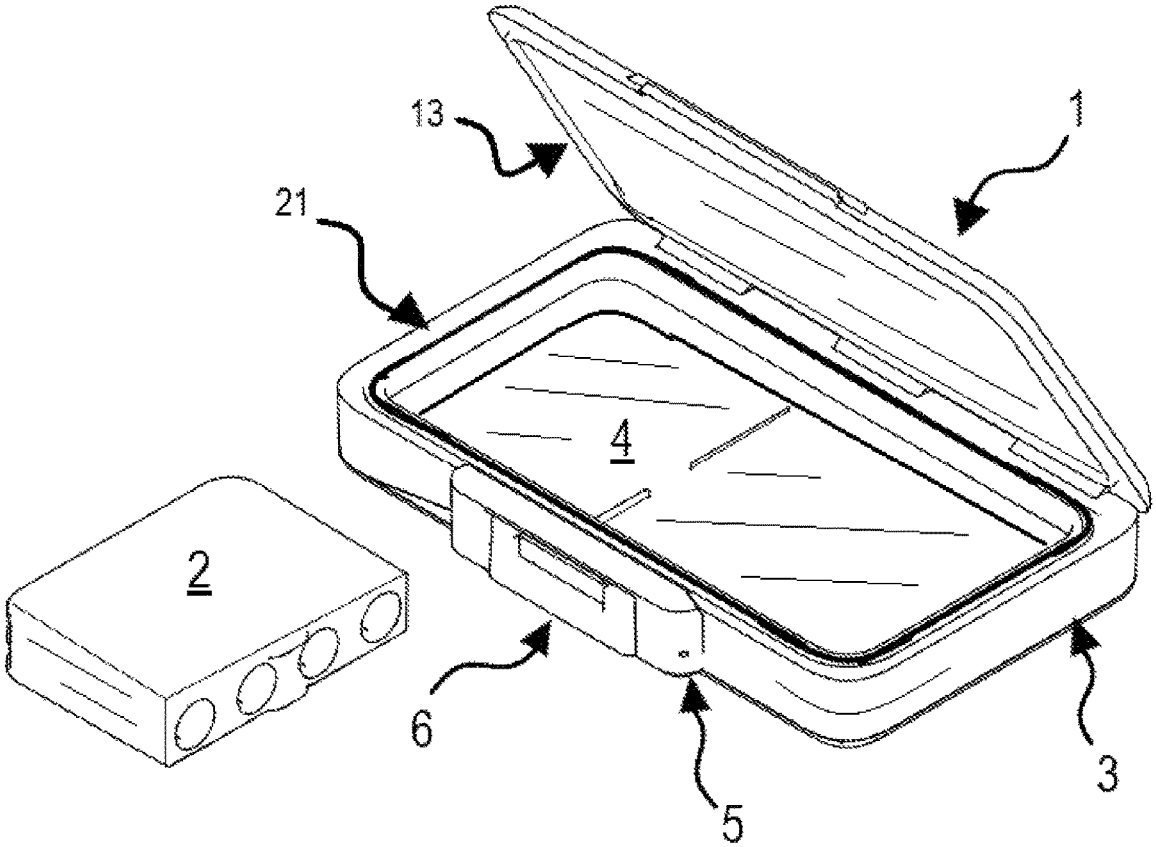
FIG. 1C: Perspective view of the invention. The invention is opened with the removable insert beside it.
Figure 1D:
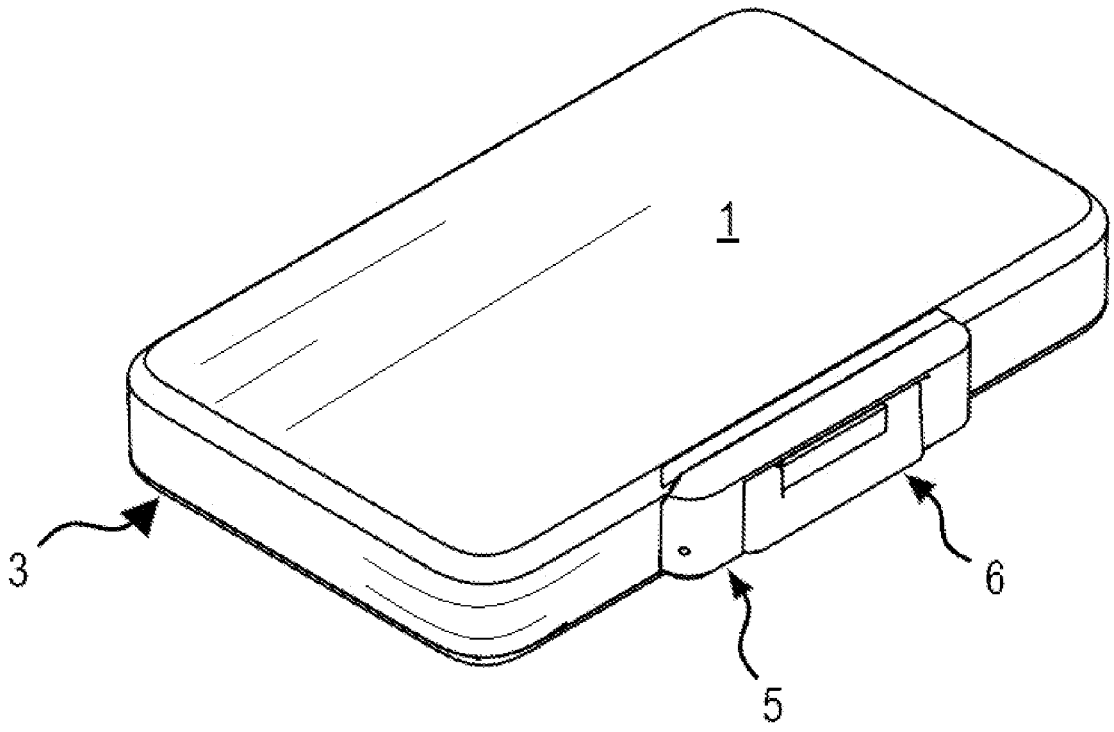
FIG. 1D: Perspective view of the invention. The invention is closed and the latch is activated.
Figure 2:
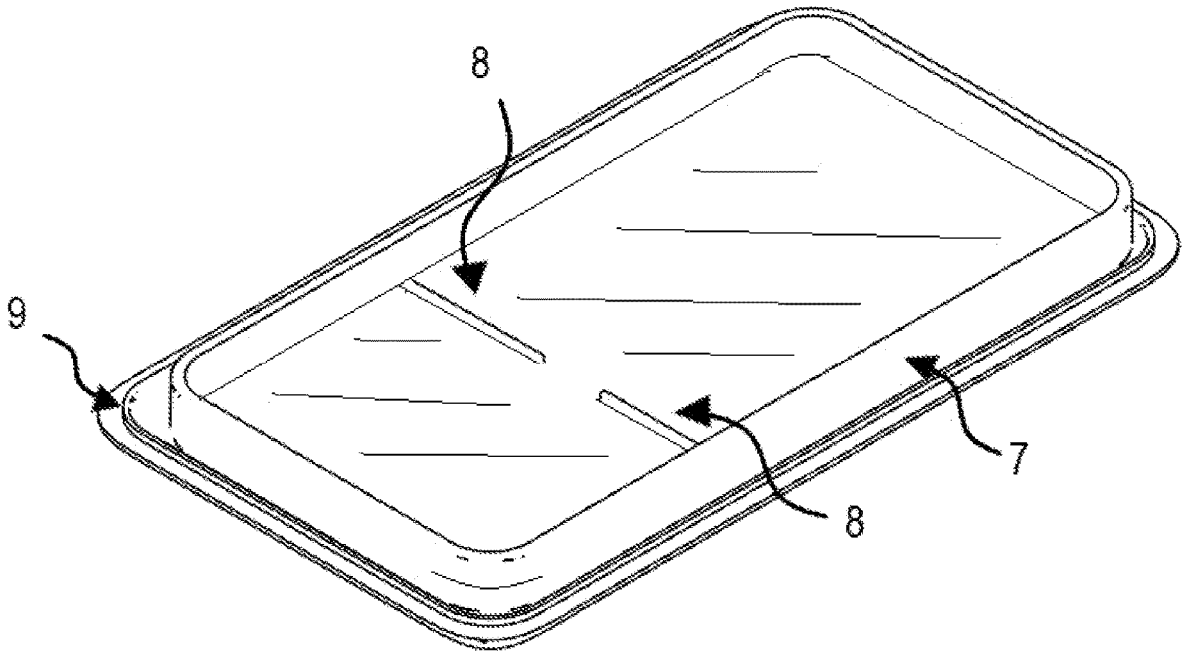
FIG. 2: View of the bottom piece of the invention pointing out the raised wall, lines of plastic used to keep the removable insert in place and the line of plastic used to be ultrasonically welded to the center piece.
Figure 3:
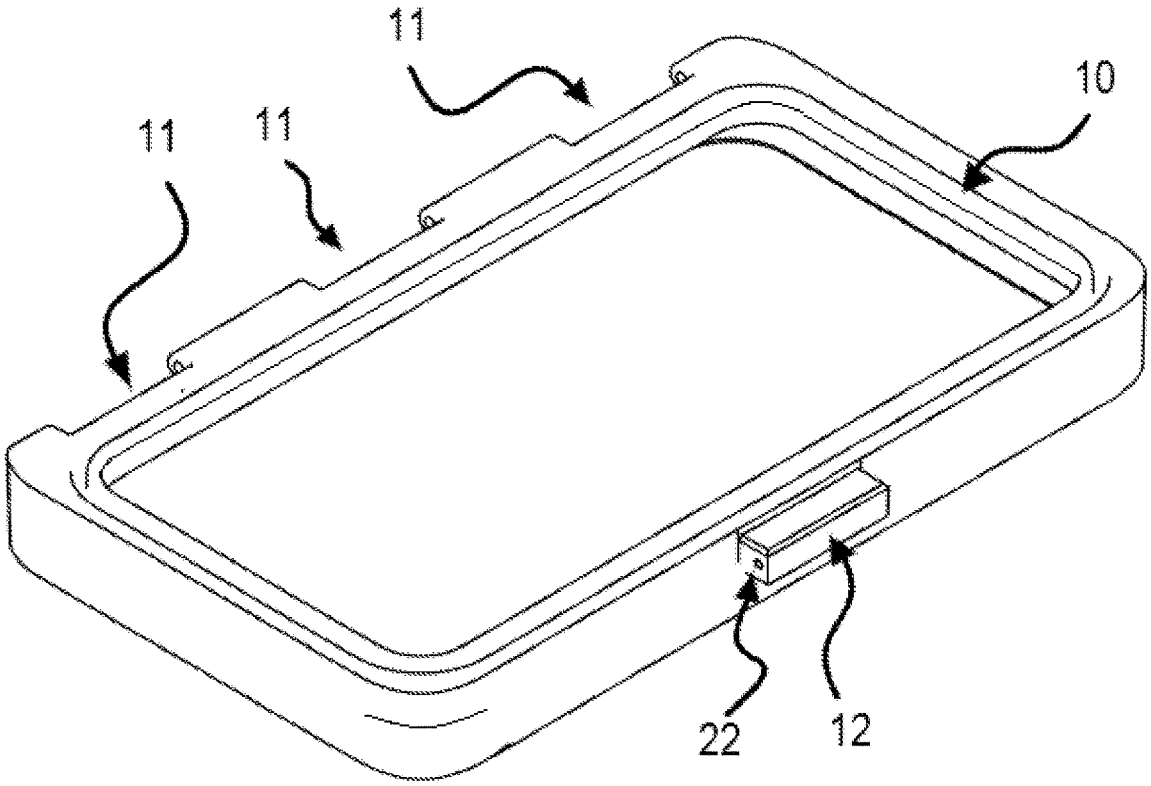
FIG. 3: View of the container center piece.

As shown in FIG. 1A-8, this invention is made of seven main parts: a gasket 21, a container lid 1, a container base 4, a container center piece 3, a removable insert 2, an inner latch 6, and an outer latch 5. The container can be made out of any material that won't absorb or be deteriorated by water and can withstand reasonable stress. The chosen material for this description is ABS plastic. The container base as shown in FIG. 2 has a tall wall 7 surrounding its inside perimeter. This space will be used to house the removable insert 2 and the cylindrical consumables. Two lines of plastic coming from both the left and right sides 8 of the container base, stopping just at the middle are there to keep the insert from moving while in container. Running along the outer edge of the container base 4, surrounding the tall wall portion 7 of the container base is a small line of plastic 9. This will be used to fuse the container base to the container center piece by method of ultrasonic welding. The container center piece as shown in FIG. 3 has a small channel 10 running along the inner perimeter of the top side. This channel will be used to hold the gasket seal 21 once it is pressed into place. The container center piece has multiple female ends 11 on one side and a protruding portion 12 on the opposite side. Both the female ends and the protruding portion have a hole running through them parallel to the container center piece.

Figure 4A:
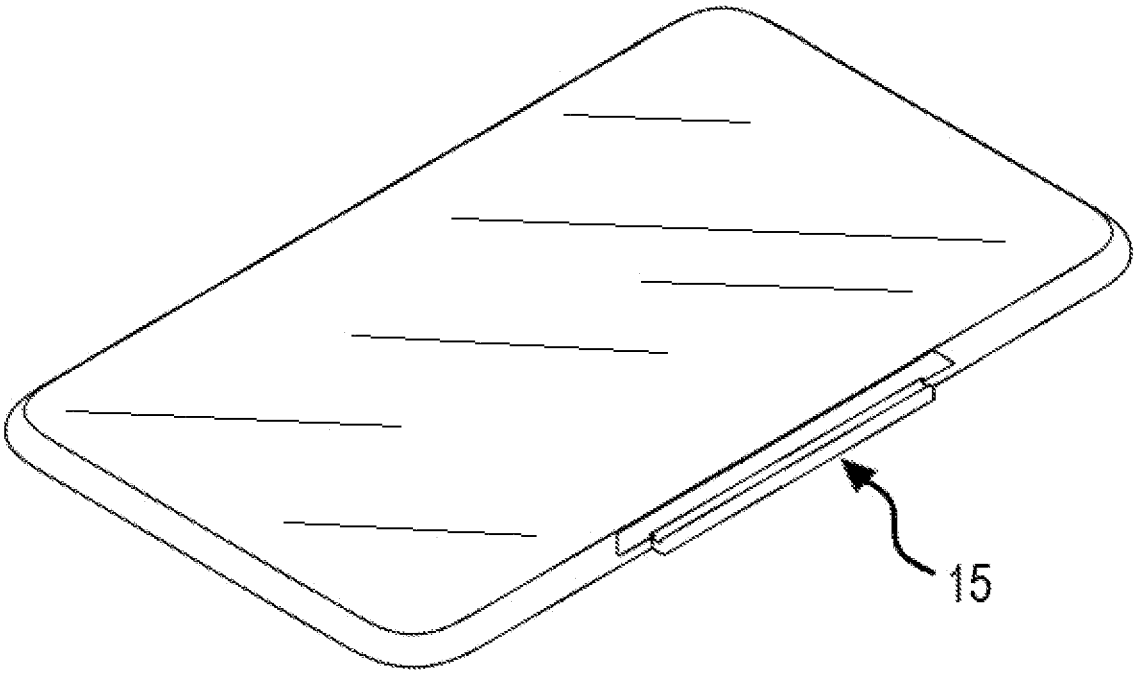
FIG. 4A: Angled view of the container lid pointing out the lip used to catch the outer latch.
Figure 4B:
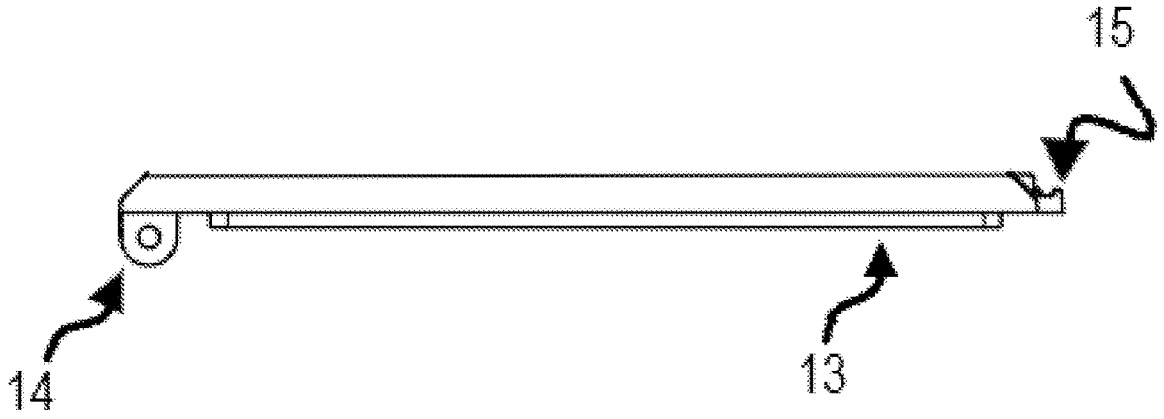
FIG. 4 B: Side profile of the container lid. This view points out the: male ends and their angle, the lip, and the live of plastic used to apply pressure to the gasket.
Figure 5:
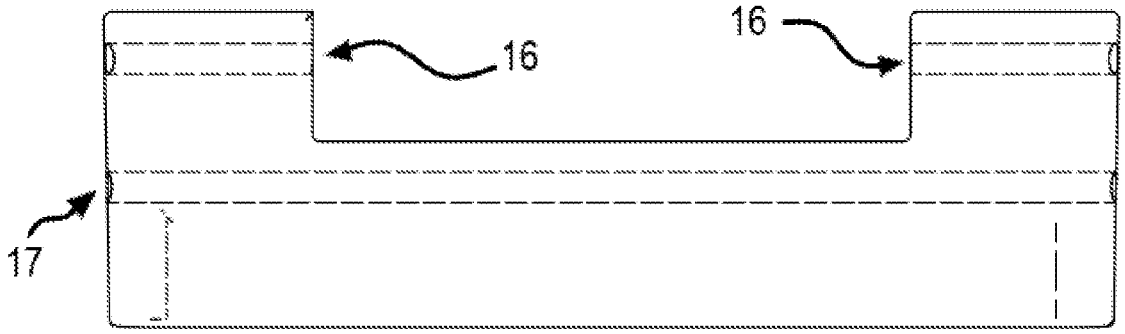
FIG. 5: View of the inner latch pointing out the sets of holes needed to connect the latch to the container center piece and the outer latch.
Figure 6:
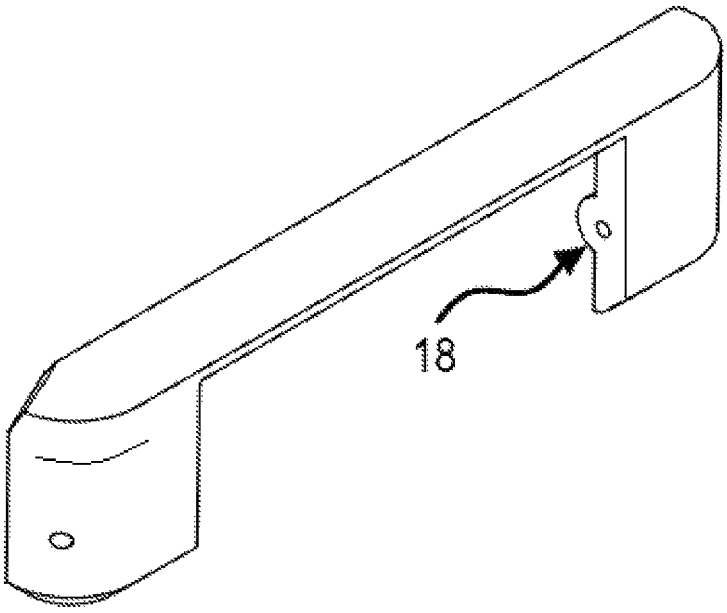
FIG. 6: View of the outer latch pointing out the holes needed to connect to the inner latch.
Figure 7A:
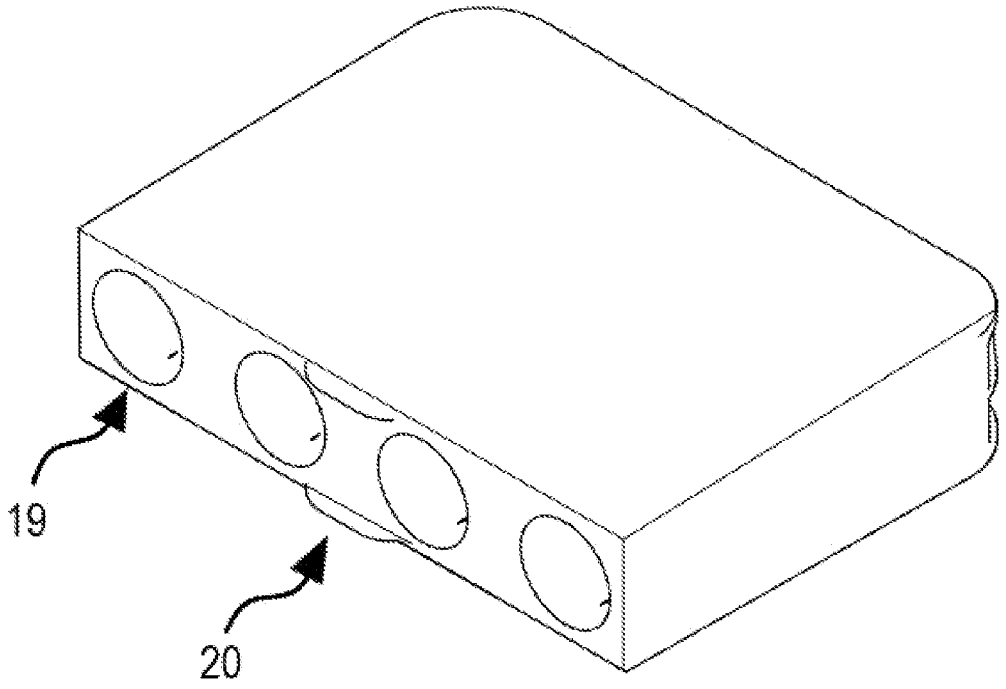
FIG. 7A: View of the removable insert. This view shows four chambers and the tabs on the top of the removable insert.
Figure 7B:
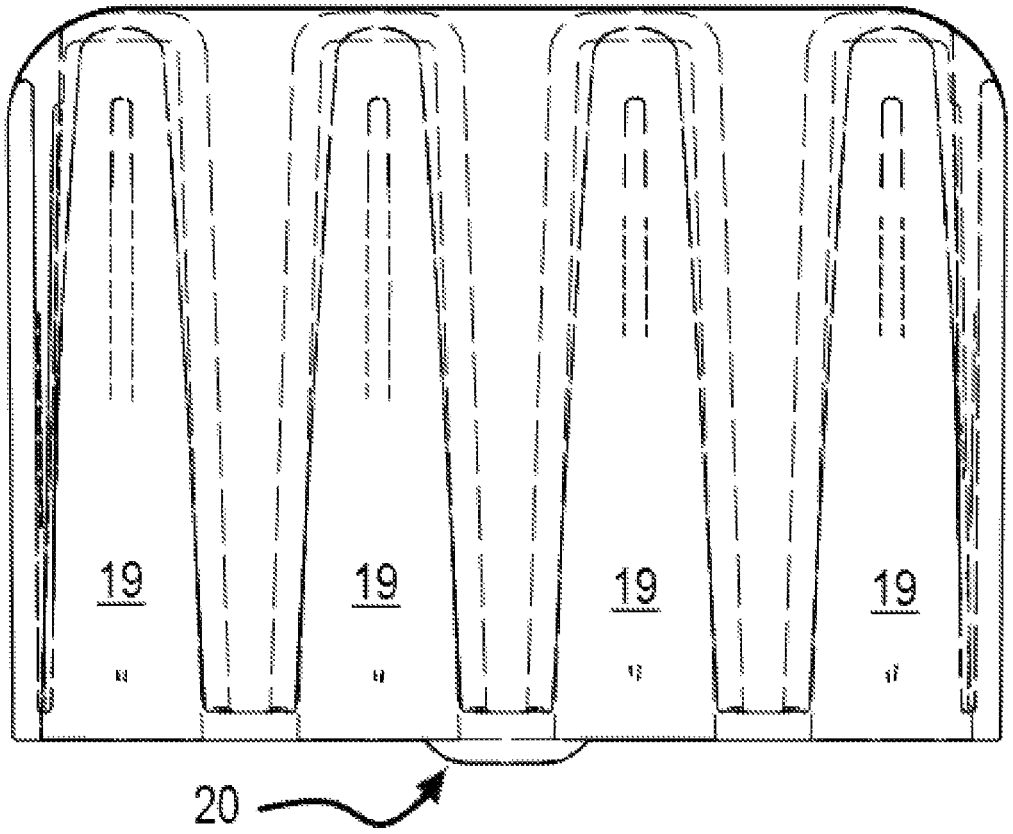
FIG. 7 B: View of the removable insert drawn to show the tapered conical design of the chambers.
Figure 8:
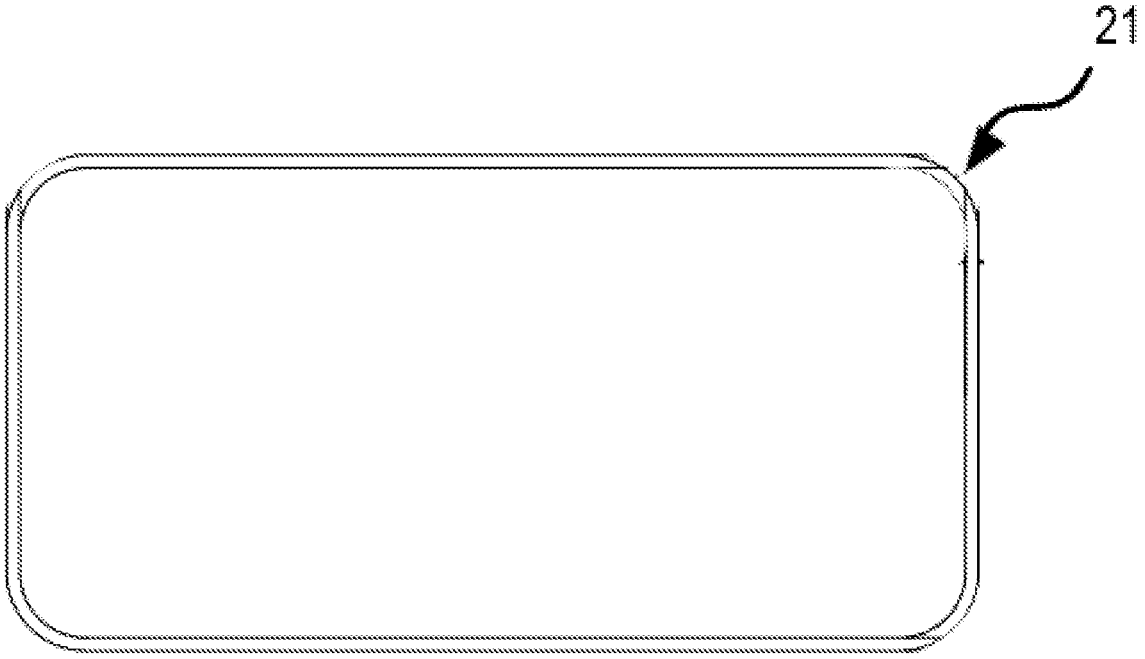
FIG. 8: View of the gasket when stretched to fit into the dedicated channel on the container center piece.

The container lid shown in FIG. 4A-4B has a small line of plastic 13 running along its inside perimeter. This line of plastic will be used to compress the gasket 21 when the container lid is closed and the latch locks the lid in place. The container lid also has multiple male ends 14 on one side forming a 90-degree angle and a thin protruding lip 15 on the opposite side. The lip is there to catch the outer latch 5 in order to keep the lid closed and pressure on the gasket, shown in FIG. 1D. The male ends 14 have holes through them running parallel to the container lid. The container lid and the container center piece are connected by placing the male ends 14 into the female ends 11 and sliding a rod through the holes. The rod must be long enough to be fully through the holes without protruding from either end. The inner latch shown in FIG. 5 is the smaller of the two latches used in the construction of this device. It is in the shape of an elongated "U" with the open center just large enough for it to fit around the bottom of the protruding portion 12 of the container center piece. The inner latch has two sets of holes running parallel to each other. One set 16 above the other 17. To connect the inner latch to the rest of the container, line up the inner latch with the protruding portion 12 of the container center piece 3 so that the latch covers the sides and the bottom of the protruding portion. See FIG. 1B-1D They are connected by sliding a rod through the top hole 16 of the inner latch and the hole 22 of the protruding portion. The rod should be long enough to go through the holes but not protrude from either end. The outer latch FIG. 6 has a similar shape to the inner latch, but it has one hole 18 and is large enough to cover the inner latch as seen in FIG. 1B-1D. The outer latch 5 is connected to the rest of the invention by lining up the outer latch 5 over the inner latch 6 with the round side of the hole 18 facing the rest of the invention. A rod is then slid through the hole in the outer latch 18 and the empty hole of the inner latch 17. The rod must be long enough to go through the holes without protruding on either end. A gasket as seen in FIG. 8 made of extruded material and of adequate size can then be placed in the channel 10 of the container center piece 3 by running a finger over the gasket allowing it to slide into place. The removable insert shown in FIG. 7A has a rectangular shape with rounded corners on the bottom matching up with the curve of the tall wall 7 of the container base 4. It has multiple chambers 19 that are wide at the top and taper down stopping at the bottom of the insert as shown in FIG. 7B. The top of the insert 2 in the center are small tabs 20 that aid users in pulling the insert out of the container. To place the insert into the container, line up the curved corners of the insert and the container and slide the insert into place. If done correctly the removable insert will fit stationary between the tall wall 7 and the lines of plastic 8 on the container base as shown in FIG. 1B-1C.

This invention solves the movement during transport issue by holding the cylindrical consumables in a removable insert 2 with conical chambers 19. The design of the chambers FIG. 7B reduces the amount of movement due to the bottom of each chamber being small enough to snuggly hold a standard filter tip in place. The chamber then slightly increases in diameter until it reaches to top of the insert. The insert 2 as a whole is removable in order to allow the container to become a tray to aid in the construction of cylindrical consumables as shown in FIG. 1B-1C. The consumables are further protected by housing them in a robust case with a gasket seal FIG. 1A-1D. The gasket 21 greatly reduces the odor leakage from the consumables in the container when closed. The gasket 21 also stops water and debris from entering the container once it is closed FIG. 1D. The container itself protects the items inside due to the material used and the sturdy reinforced wall design. The container is easily opened and closed using the attached large latch 5 and 6. The container is opened by pulling the bottom of the inner latch 6 away from the container and lifting the lid 1. The container is closed by shutting the lid 1, placing the outer latch 5 on the lip of the lid 15, and pushing the inner latch 6 towards the container. The container is used for aiding in the creation of cylindrical consumables and for the safe transport of those consumables. The empty container is unlocked by pulling outward on the inner latch 6. The container can then be opened by lifting the lid 1, revealing the removable insert 2 as shown in FIG. 1B. The insert 2 would then be taken out of the container by pulling on the tab 20. The insert 2 and the container would then be placed on a flat surface as shown in FIG. 1C. The empty container can then be used as a rolling station to craft the users chosen cylindrical consumable. As each consumable is made, it can be placed in the insert as it holds each one unaided on a flat surface. Once the user has used the desired number of chambers 19, the insert 2 can be placed back into the container where it was previously found. The container can then be closed by lowering the lid 1, aligning the outer latch 5 with the lid 1, then pushing the inner latch 6 toward the container. This provides enough compression on the gasket seal 21 to render the container substantially airtight.

The invention claimed is:

1. A container, comprising: a gasket seal made of compressible material; a removable insert having multiple chambers; the removable insert configured to be placed inside the container; an outer latch; an inner latch; a container lid having multiple male ends on one side; a container base with raised walls surrounding the inside perimeter; an independent container center piece having multiple female ends on one side and a protruding portion made to be accepted by the inner latch on the opposite side, wherein the independent container center piece is non-removably secured to the container base and the independent container center piece being exterior to the raised walls.

2. A container as in claim 1, wherein said gasket is removably placed into the dedicated channel made for the gasket surrounding the perimeter of the container center piece.

3. A container as in claim 1, wherein said Container lid is attached to the container center piece by placing the male and female ends together and securing them with a stainless-steel rod.

4. A container as in claim 1, wherein said inner latch is attached to the container center piece opposite of the hinged side using a stainless-steel rod.

5. A container as in claim 1, wherein said outer latch is attached to the inner latch.

6. A container as in claim 1, wherein said removable insert having multiple chambers has at least one chamber with a tapered conical shape.

7. A method for turning the container as in claim 1 into a rolling station comprising:

removing the insert by pulling up on the center tab;

placing the insert on a flat surface with the chambers facing up;

placing the now empty container base side down on a flat surface.

* * * * *